United States Patent [19]

Fujisawa

[11] Patent Number: 4,864,999

[45] Date of Patent: Sep. 12, 1989

[54] FUEL CONTROL APPARATUS FOR ENGINE

[75] Inventor: Eiichi Fujisawa, Yokohama, Japan

[73] Assignee: Nissan Motor Co., Ltd., Yokohama, Japan

[21] Appl. No.: 193,764

[22] Filed: May 13, 1988

[30] Foreign Application Priority Data

May 18, 1987 [JP] Japan ..... 62-119094

[51] Int. Cl.[4] ..... F02M 51/00

[52] U.S. Cl. ..... 123/492; 123/493

[58] Field of Search ..... 123/492, 493, 494, 422, 123/423

[56] References Cited

U.S. PATENT DOCUMENTS

| | | | |
|---|---|---|---|
| 4,520,783 | 6/1985 | Matsushita et al. | 123/492 |
| 4,561,404 | 12/1985 | Kando et al. | 123/492 |
| 4,685,436 | 8/1987 | Oba | 123/492 |
| 4,690,117 | 9/1987 | Isobe et al. | 123/492 |
| 4,707,792 | 11/1987 | Naitou | 123/492 |
| 4,711,218 | 12/1987 | Kabosin | 123/492 |
| 4,751,909 | 6/1988 | Otobe | 123/492 |
| 4,781,163 | 11/1988 | Jantelat et al. | 123/492 |

FOREIGN PATENT DOCUMENTS

| | | | |
|---|---|---|---|
| 56-27040 | 3/1981 | Japan | 123/492 |

*Primary Examiner*—R. A. Nelli

*Attorney, Agent, or Firm*—Foley & Lardner, Schwartz, Jeffery, Schwaab, Mack, Blumenthal & Evans

[57] ABSTRACT

In a fuel control apparatus by which a basic fuel quantity $T_p$ is first calculated on the basis of a detected intake air flow rate Q and a detected engine speed N as $T_p = KQ/N$ (K: constant) and the calculated basic fuel quantity $T_p$ is corrected on the basis of a correction coefficient COEF related to various engine operating conditions (e.g. coolant temperature), air/fuel ratio feedback correction coefficient $\alpha$, and a battery voltage correction coefficient $T_s$ as $T_i = T_p \times COEF \times \alpha + T_s$, when an engine is accelerated, an initial fuel increment coefficient $KAC_0$ is determined on the basis of throttle opening rate and engine speed, and added to the correction coefficient as $COEF + KAC_0$, and thereafter the initial fuel increment coefficient $KAC_0$ is reduced at a small coefficient decrement rate $DKAC_1$ at lower engine speed to prevent hesitation, but at a large coefficient decrement rate $DKAC_2$ at higher engine speed to prevent an overrich air/fuel ratio (excessive CO exhaust quantity).

6 Claims, 5 Drawing Sheets

FUEL CONTROL APPARATUS FOR ENGINE

BACKGROUND OF THE INVENTION

1. Field of the Invention

The present invention relates generally to a fuel control apparatus for an engine and more specifically to a fuel control apparatus for an internal combustion engine which can improve acceleration performance while reducing the quantity of exhausted carbon monoxide.

2. Description of the Prior Art

Various fuel control apparatus for internal combustion engines have so far been proposed. One example of these prior-art apparatus is disclosed in Japanese Patent Kakai (Published and Unexamined) Application No. 56-27040 by the same applicant.

In this prior-art apparatus, first a basic fuel injection quantity $T_p$ is calculated on the basis of an intake air flow quantity Q detected by an air flow meter and an engine revolution speed N detected by an engine speed as $T_p=KQ/N$ (where K is a constant); then various correction coefficients COEF according to engine operating conditions (e.g. coolant temperature), an air-fuel ratio feedback correction coefficient a, and a battery voltage dependent correction value $T_s$ are calculated; and finally a fuel injection quantity $T_i$ at constant engine speed can be calculated as follows:

$$T_i=T_p\times COEFs\times\alpha+T_s$$

Fuel injection quantity calculated as described above is supplied to an engine by applying fuel injection pulse signals (representative of the above calculated fuel injection quantity $T_i$) to a fuel injection value in synchronism with ignition signals generated for each half turn of an engine crankshaft.

In addition, when acceleration engine operating conditions are detected on the basis of a change in throttle valve opening rate, an initial fuel increment coefficient $KAC_0$ is determined on the basis of the detected engine operating conditions such as detected coolant temperature detected throttle valve opening rate, etc. In this calculation, the calculated initial fuel increment coefficient $KAC_0$ is added to the above-mentioned various correction coefficients COEFs in order to increase engine output and therefore improve acceleration performance. Thereafter, the fuel quantity is reduced gradually by decreasing the above-mentioned initial fuel increment coefficient $KAC_0$ at a constant coefficient decrement rate DKAC in synchronism with the engine operation (e.g. for each half crankshaft revolution).

In the above-mentioned prior-art fuel control apparatus as described above, however, since the initial fuel increment coefficient $KAC_0$ is fixedly determined when an engine is accelerated and then reduced gradually at a constant coefficient decrement rate DKAC in synchronism with the engine operation, there exist the following problems: when the coefficient decrement rate is determined to a fixed value so that the engine speed rise rate during engine acceleration operation can be optimized, the engine speed can of course be increased at an optimum rise rate as shown by the solid curve in FIG. 1 (the middle). However, even after the engine speed has been increased sufficiently, since the coefficient decrement rate is determined at the same fixed rate, there exists a problem in that an excessive quantity of fuel is supplied to the engine at high engine speed range (overrich in air/fuel ratio) and therefore the quantity of exhausted carbon monoxide CO is excessively increased also as shown in FIG. 1 (the upper).

On the other hand, when the coefficient decrement rate is determined to a large value in order to reduce the quantity of exhausted carbon monoxide, since the fuel quantity to be increased is reduced sharply and therefore the engine speed is excessively reduced as shown by the dashed curve in FIG. 1 (the middle), there exists a problem in that it is impossible to obtain an optimum engine speed rise rate as shown by the solid curve in FIG. 1 (the middle), thus resulting in accel hesitation (when the accel pedal is depressed, the engine cannot be accelerated smoothly) and therefore deterioration in engine acceleration performance.

SUMMARY OF THE INVENTION

With these problems in mind, therefore, it is the primary object of the present invention to provide a fuel supply apparatus for an engine which can improve acceleration performance while reducing the quantity of exhausted carbon monoxide.

To achieve the above-mentioned object, a fuel control apparatus for an engine according to the present invention comprises: (a) a unit for detecting engine acceleration conditions; (b) a unit for detecting engine speed; (c) a unit, coupled to said engine acceleration condition detecting unit, for determining an initial fuel quantity when the engine is being accelerated; (d) means, coupled to said engine speed detecting a unit, for adjustably determining a fuel quantity decrement rate according to a detected engine speed; (e) unit, coupled to said initial fuel quantity determining means and said fuel quantity decrement rate determining means, for calculating a fuel quantity on the basis of the determined initial fuel quantity and the determined fuel quantity decrement rate for each predetermined time period; (f) means, coupled to said fuel quantity calculating a unit, for generating a fuel supply signal representative of the calculated fuel quantity; and (g) a unit, coupled to said fuel supply signal generating a unit, for supplying fuel into the engine in response to the generated fuel supply signal.

The engine acceleration condition detecting unit includes a unit for detecting throttle opening rate and a unit for detecting engine speed. The initial fuel quantity determining a unit calculates an initial fuel quantity on the basis of an initial fuel increment coefficient determined on the basis of a detected throttle opening rate and a detected engine speed. The fuel quantity calculating unit calculates a fuel quantity whenever a crankshaft rotates through a predetermined angle. Further, fuel quantity decrement rate determining unit determines a small fuel decrement rate to gently decrease the fuel quantity when the detected engine speed is low, but a large fuel decrement rate to sharply decrease the fuel quantity when the detected engine speed is high.

Further, to achieve the above-mentioned object, a method of controlling fuel supplied to an engine of the present invention comprises the steps of: (a) detecting engine operating conditions including an engine speed; (b) detecting an engine acceleration status on the basis of the detected engine operating conditions; (c) if an engine acceleration status is detected, determining an initial fuel increment coefficient $KAC_0$ on the basis of the detected engine operating conditions; (d) calculating a fuel quantity $T_i$ on the basis of the detected initial fuel increment coefficient $KAC_0$; (e) determining whether current engine speed is lower than a predetermined value; (f) if lower than the predetermined value, determining a small coefficient decrement rate $DKAC_1$ to reduce the initial fuel increment coefficient $KAC_0$; (g) if higher than the predetermined value, determining a large coefficient decrement rate $DKAC_2$ to reduce the fuel increment coefficient $KAC_0$; and (h) calculating a fuel quantity on the basis of the reduced fuel increment coefficient KAC for each predetermined period.

The fuel quantity $T_i$ is calculated in accordance with the following expression:

$$T_i = T_p \times \alpha \times (COEF + KAC) + T_s$$

where $T_p$ denotes a basis fuel quantity; $\alpha$ denotes an air/fuel ratio feedback correction coefficient; COEF denotes a coefficient adjusted according to engine operating conditions and $T_s$ denotes a battery voltage related correction coefficient.

In the apparatus or the method of the present invention, since the initial fuel increment coefficient (which increases fuel quantity) can be reduced at coefficient decrement rates determined according to engine speed, it is possible to improve engine acceleration performance and simultaneously to decrease the quantity of exhausted carbon monoxide.

DETAILED DESCRIPTION OF THE PREFERRED EMBODIMENTS

Figure 1:
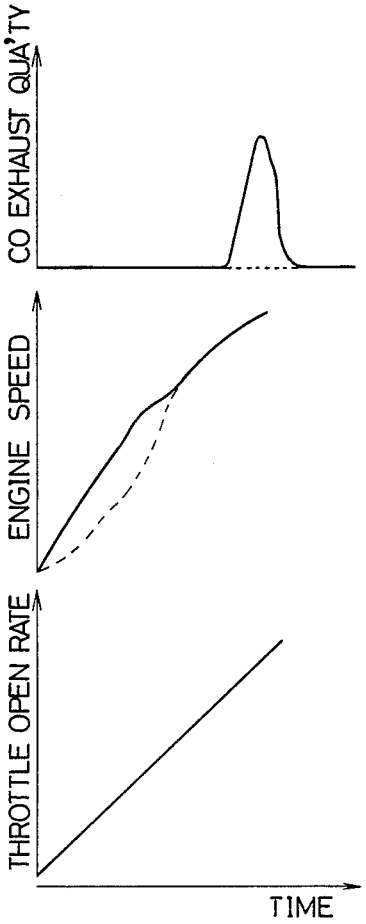
FIG1 (Prior Art)
FIG. 1 is three graphical representation, for assistance in explaining problems involved in a prior-art fuel supply apparatus.
Figure 2:
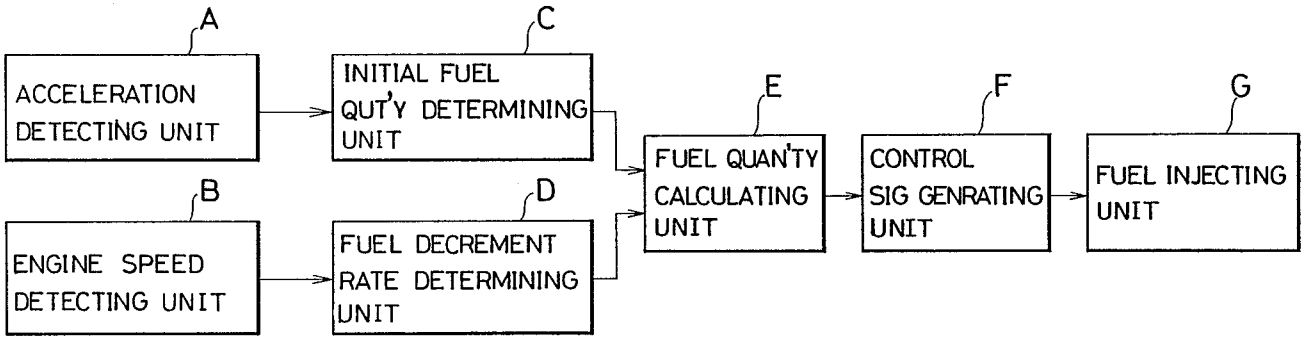
FIG. 2 is a basic block diagram showing a fuel supply apparatus of the present invention.

FIG. 2 shows a basic structure of the apparatus of the present invention. The control apparatus comprises acceleration condition detecting unit A for detecting engine acceleration conditions; engine speed detecting unit B for detecting engine revolution speed; initial fuel determining unit C for determining initial fuel quantity according to detected engine acceleration conditions; fuel decrement rate determining unit D for adjustably determining fuel decrement rate to reduce the determined initial fuel quantity for fuel quantity correction according to the detected engine revolution speed; fuel quantity calculating unit E for calculating a fuel quantity on the basis of the determined initial fuel quantity and the determined fuel quantity decrement rate for each predetermined period; and fuel signal generating unit F for generating a fuel supply signal representative of the calculated fuel quantity; and fuel injecting unit G for supplying fuel into the engine in response to the generated fuel supply signal.

In summary, the initial acceleratin fuel quantity can be reduced by decrementing an initial fuel increment coefficient (determined on the basis of detected engine acceleration operating conditions) on the basis of fuel decrement rates adjusted according to detected engine speed. In practice, the initial fuel increment coefficient can be reduced at large fuel decrement rate, when the engine speed is high.

Figure 3:
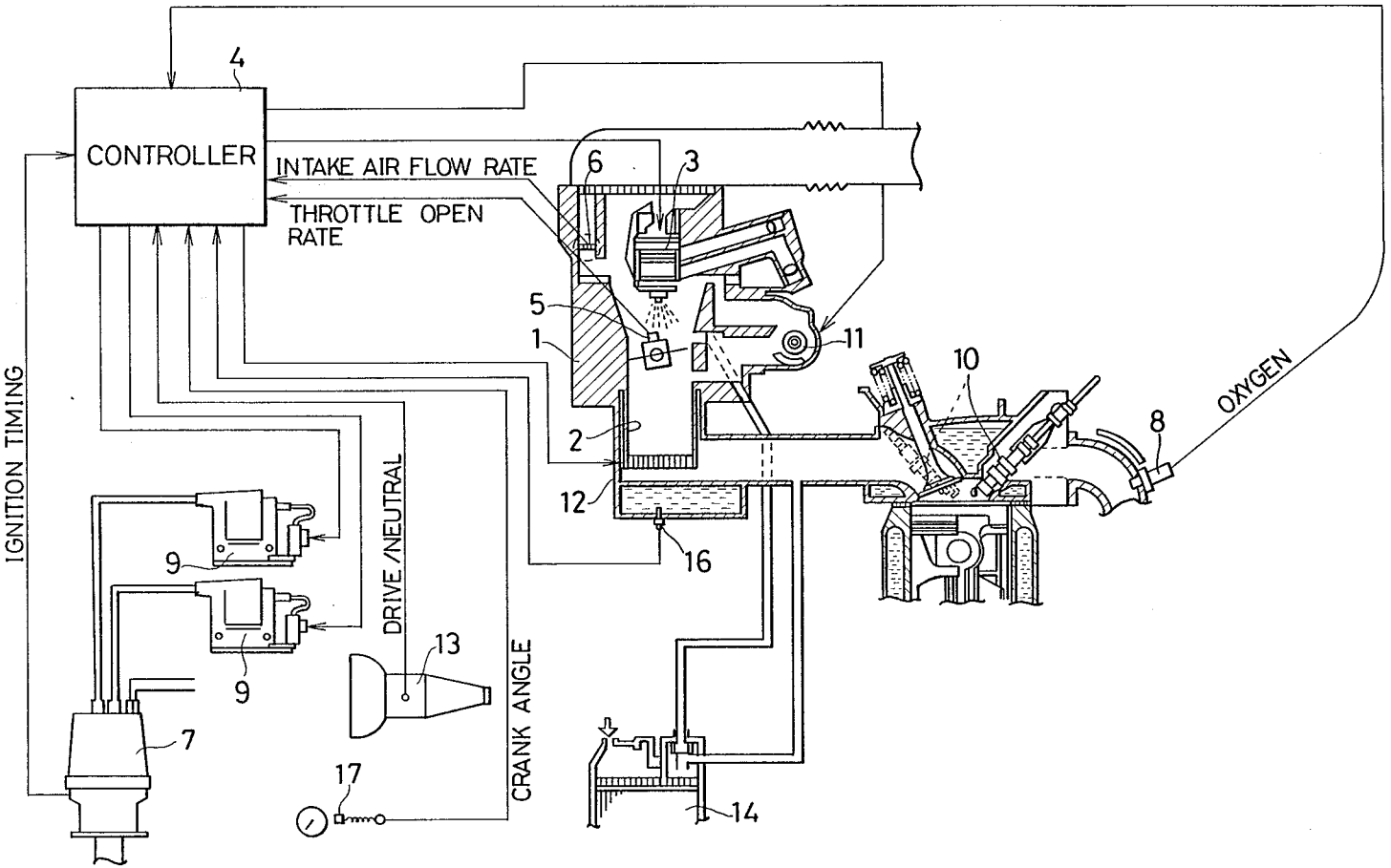
FIG. 3 is a schematic illustration, partially block diagram of an embodiment the apparatus of the present invention.

FIG. 3 shows an embodiment of the fuel supply apparatus of the present invention. In the drawing, a single point injection system for distributing fuel to each cylinder via a throttle valve is shown by way of example.

In FIG. 3, a fuel injection value 3 is provided in an intake passage 2 on the upstream side of a throttle valve 1. Fuel injected through this fuel injection valve 3 is supplied via the throttle valve 1 into an engine cylinder.

A controller 4 including a CPU, a RAM, a ROM, etc. receives various engine operating condition detection signals detected by various sensors such as a throttle opening rate sensor 5 attached to the throttle to detect opening rates fo the throttle valve 1; a hot-wire air flow meter 6 disposed in an intake air passage to detect the quantity of intake air flow; a crankshaft angle sensor 17 for detecting an angular position of an engine crankshaft; a timing signal generator (not shown) disposed in a distributor 7; an oxygen sensor 8 attached to an exhaust passage to detect oxygen concentration in engine exhaust gas; an coolant temperature sensor 16; a transmission 13 for detecting engine drive/neutral conditions, etc.

Further, in FIG. 3, the reference numeral 9 denotes ignition coils; 10 denotes ignition plugs; 11 denotes an auxiliary air control valve; 12 denotes an intake air heater; and 14 denotes a canister.

In comparison of FIG. 2 with FIG. 3, the accel operating condition detecting unit A corresponds to the throttle open rate sensor 5; the engine speed detecting unit B corresponds to the crank angle sensor 17 and the controller 4 for calculating engine speed on the basis of the detected pulse period of crank angle sensor signal; the initial fuel quantity determining unit C, the fuel decrement rate determining unit D, the fuel quantity calculating unit E, and the control signal generating unit F correspond to the controller 4; and the fuel supplying unit G corresponds to the fuel injection valve 3.

Figure 4:
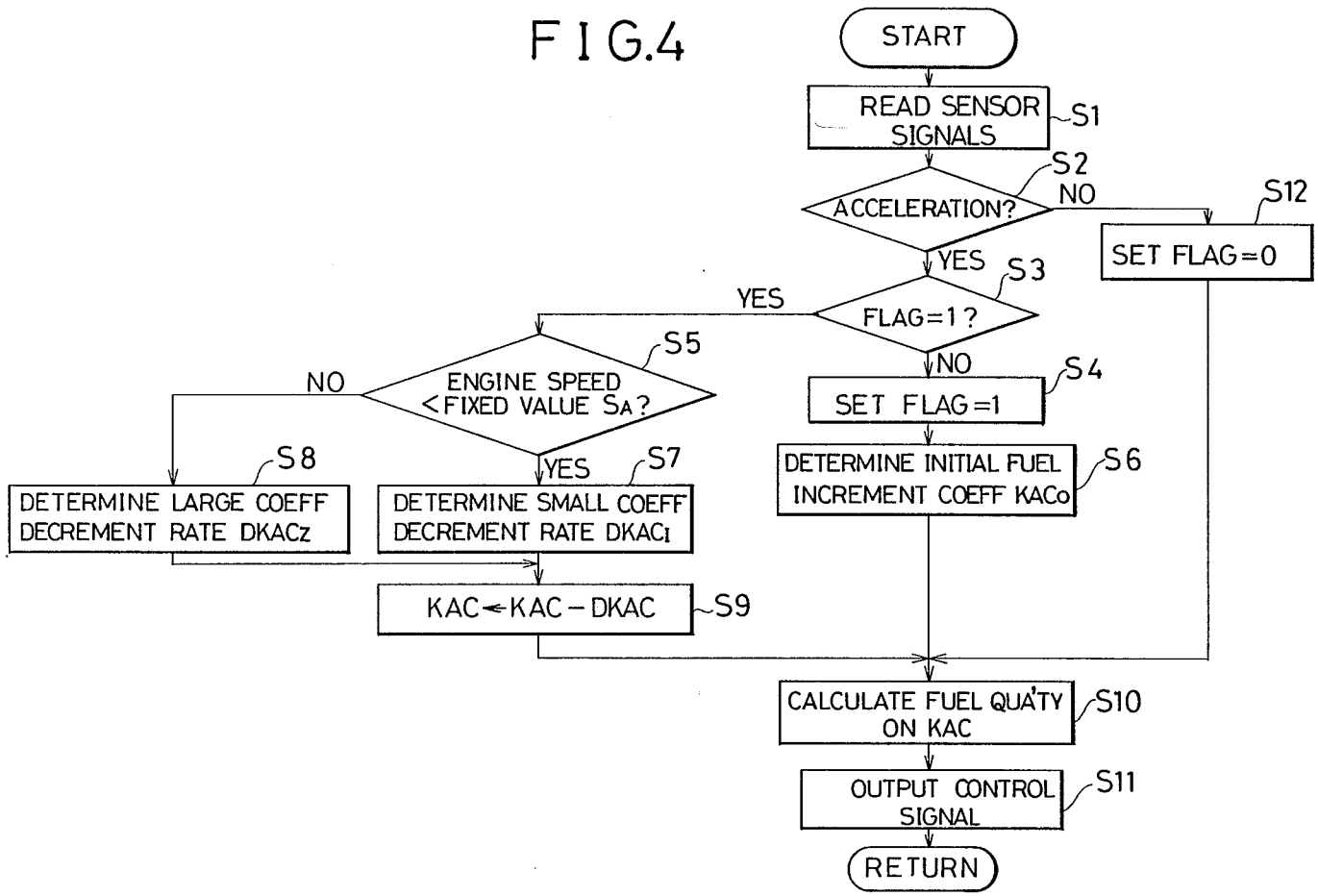
FIG. 4 is a flowchart for assistance in explaining the operation of the apparatus of the present invention.

The controller 4 operates in accordance with a flowchart as shown in FIG. 4, for instance.

Control first reads various sensor signals such as a throttle valve opening rate sensor signal, an engine speed signal, etc. (in step S1). Control checks whether the engine is operated under accelerated conditions on the basis of the detected throttle valve opening rate and the detected engine speed (in step S2). If YES, control proceeds to the succeeding step S3 to check whether FLAG set in the preceeding routine is 1 (indicative of acceleration conditions) (in step S3). If NO in step S2, control proceeds to the step S12 to set FLAG=0 (indicative of no acceleration conditions).

If NO (FLAG=0) in step S3, since this indicates that acceleration operation has started, control proceeds to the succeeding step S4 to set FLAG=1 and store the FLAG=1 in a RAM (in step S4). Thereafter, control proceeds to the succeeding step S6 to determine an initial fuel increment coefficient $KAC_0$ on the basis of the detected throttle valve opening rate and the detected engine speed by retrieving a ROM provided in the controller 4 (e.g. in accordance with table look-up method) (in step S6). In the succeeding step S10, control calculates a basic fuel injection quantity $T_i$ on the basis of the initial fuel increment coefficient $KAC_0$ and in accordance with the following expression:

$$T_i = T_p \times \alpha \times (COEF + KAC_0) + T_s$$

where $T_p$ denotes a basic fuel quantity determined on the basis of intake air flow quantity and engine speed; $\alpha$ denotes an air/fuel ratio feedback correction coefficient; COEF denotes a correction coefficient adjusted according to engine operating conditions; and $T_s$ denotes a correction coefficient based upon a battery voltage (in step S10). An injection pulse signal representative of the calculated basic fuel injectin quantity $T_i$ is applied to the fuel injection valve 3 (in step S11).

If YES (FLAG=1) in step S3, since this indicates that acceleration operating conditions are continued, control proceeds to step S5. Here, control checks whether the detected engine speed during acceleration operation is less than a predetermined value (e.g. $S_A$=1900 r.p.m.) (in step S5). If YES, since this indicates that the engine speed is in a lower engine speed range, control proceeds to the succeeding step to retrieve a relatively small coefficient decrement rate $DKAC_1$ (e.g. 0.025) from the ROM (in step S7). In contrast with this, if NO in step S5, since this indicates that the engine speed is in a higher engine speed range, control retrieves a relatively large coefficient decrement rate $DKAC_2$ (e.g. 0.1) from the ROM (in step S8). The above determined coefficient decrement rate $DKAC_1$ or $DKAC_2$ is subtracted from the fuel increment coefficient KAC determined by the preceeding routine as $$KAC \leftarrow KAC - DKAC$$

whenever the engine crank shaft rotates by a half turn. The newly determined fuel increment coefficient KAC is stored in the RAM for each half crankshaft revolution. In the above step S9, it is also possible to reduce the fuel increment coefficient for each predetermined time period. The above subtraction calculations $KAC \leftarrow KAC - DKAC$ are repeated until the fuel increment coefficient KAC is reduced down to zero.

On the other hand, If NO (in step S2), since this indicates that the engine is operating in non-acceleration conditions, the flag is set to FLAG=0 and control stores this flag in the RAM (in step S12). In the succeeding step S10, a fuel injectin quantity $T_i$ is calculated on the basis of the fuel increment coefficient KAC determined in step S6 or S9 (without reducing the fuel increment coefficient) as follows:

$$T_i = T_p \times \alpha + (COEF + KAC) + T_s$$

as already explained (in step S10).

Figure 5:
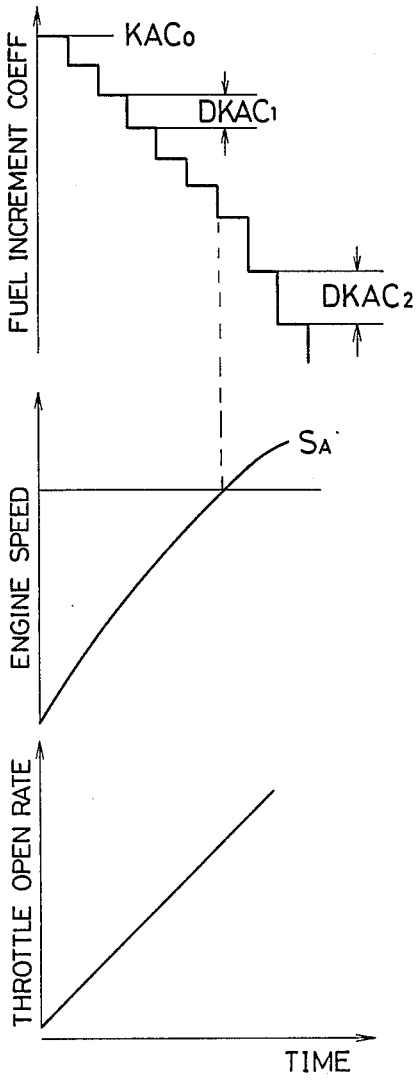
FIG. 5 is graphical representations for assistance in explaining the acceleration operation of the apparatus of the present invention.

The control operation is summarized with reference to FIGS. 4 and 5.

When the engine is initially accelerated, an initial fuel increment coefficient $KAC_0$ is determined (in step S6). On the basis of this initial coefficient $KAC_0$, a fuel injection quantity $T_i$ is calculated (in step S10). Once the engine is accelerated, engine speed is detected and compared with a predetermined value (in step S5). When the engine speed is low, a relatively small coefficient decrement rate $DKAC_1$ is selected; when the engine speed is high, a relatively large coefficient decrement rate $DKAC_2$ is selected. The fuel increment coefficient KAC is continuously reduced by the determined coefficient decrement rate DKAC for each half crankshaft revolution or for each predetermined time interval. The fuel injection quantity is repeatedly calculated on the basis of the subtracted fuel increment coefficient KAC.

Therefor, as shown in FIG. 5 (the upper), when engine speed is low, since fuel increment coefficient is reduced in accordance with a relatively small coefficient decrement rate $DKAC_1$ for each half crankshaft revolution, the fuel quantity is reduced gently, so that air/fuel ratio can be optimized during acceleration operation at low engine speed range. Therefore, it is possible to prevent the occurrence of hesitation without lowering acceleration performance.

On the other hand, when the engine speed is high, since fuel increment coefficient is reduced in accordance with a relatively large coefficient decrement rate $DKAC_2$ for each half crankshaft revolution, the fuel quantity is reduced sharply, so that air/fuel ratio can be optimized during acceleration operation at high engine speed range. Therefore, it is possible to prevent the occurrence of overrich or an increase in the quantity of exhausted monoxide.

As described above, in the fuel apparatus for an engine according to the present invention; since the initial acceleration increment fuel quantity can be reduced in accordance with fuel decrement rates adjusted according to engine speed, it is possible to obtain optimized air/fuel ratio without producing hesitation at low engine speed range and without producing overrich at high engine speed range, while improving engine acceleration performance.

What is claimed is:

1. A fuel control apparatus for an engine, comprising:

(a) means for detecting engine acceleration conditions on the basis of a throttle opening rate;

(b) means for detecting engine speed;

(c) means, coupled to said engine acceleration condition detecting means, for determining an initial fuel quantity on the basis of an initial fuel increment coefficient which is in turn determined on the basis of a detected throttle opening rate and a detected engine speed, when the engine is being accelerated;

(d) means, coupled to said engine speed detecting means, for adjustably determining a fuel quantity decrement rate according to a detected engine speed;

(e) means, coupled to said initial fuel quantity determining means and said fuel quantity decrement rate determining means, for calculating a fuel quantity on the basis of the determined initial fuel quantity and the determined fuel quantity decrement rate for a predetermined time period;

(f) means, coupled to said fuel quantity calculating means, for generating a fuel supply signal representative of the calculated fuel quantity; and (g) means, coupled to said fuel supply signal generating means, for supplying fuel into the engine in response to the generated fuel supply signal.

2. The fuel control apparatus for an engine as set forth in claim 1, wherein said fuel quantity calculating means calculates a fuel quantity whenever a crankshaft rotates through a predetermined angle.

3. The fuel control apparatus for an engine as set forth in claim 1, wherein said fuel quantity decrement rate determining means determines a small fuel decrement rate to gently decrease the fuel quantity when the detected engine speed is low, but a large fuel decrement rate to sharply decrease the fuel quantity when the detected engine speed is high.

4. A method of controlling fuel supplied to an engine, comprising the steps of:

(a) detecting engine operating conditions including an engine speed and a throttle opening rate;

(b) detecting an engine acceleration status on the basis of the detected engine operating conditions;

(c) if an engine acceleration status is detected, determining an initial fuel increment coefficient $KAC_0$ on the basis of the detected throttle opening rate and engine speed;

(d) calculating a fuel quantity $T_i$ on the basis of the detected initial fuel increment coefficient $KAC_0$;

(e) determining whether current engine speed is lower than a predetermined value;

(f) if lower than the predetermined value, determining a small coefficient decrement rate $DKAC_1$ to reduce the initial fuel increment coefficient $KAC_0$;

(g) if higher than the predetermined value, determining a large coefficient decrement rate $DKAC_2$ to reduce the fuel increment coefficient $KAC_0$; and (h) calculating a fuel quantity on the basis of the reduced fuel increment coefficient KAC, all the steps being repeated for each predetermined period.

5. The method of claim 4, wherein all the steps are repeated whenever an engine crankshaft rotates by a predetermined turn.

6. The method of claim 4, wherein fuel quantity $T_i$ is calculated in accordance with the following expression:

$$T_i = T_p \times \alpha \times (COEF + KAC) + T_s$$

where $T_p$ denotes a basic fuel quantity; $\alpha$ denotes an air/fuel ratio feedback correction coefficient; COEF denotes a coefficient adjusted according to engine operating conditions and $T_s$ denotes a battery voltage related correction coefficient.

* * * * *